United States Patent [19]

Gottier et al.

[11] Patent Number: 5,017,204

[45] Date of Patent: May 21, 1991

[54] DEPHLEGMATOR PROCESS FOR THE RECOVERY OF HELIUM

[75] Inventors: Gerry N. Gottier, Emmaus; Donn M. Herron, Fogelsville, both of Pa.

[73] Assignee: Air Products and Chemicals, Inc., Allentown, Pa.

[21] Appl. No.: 471,300

[22] Filed: Jan. 25, 1990

[51] Int. Cl.[5] ..... F25J 3/00

[52] U.S. Cl. ..... 62/11; 62/24; 62/36; 62/42

[58] Field of Search ..... 62/11, 23, 24, 32, 36, 62/42

[56] References Cited

U.S. PATENT DOCUMENTS

| | | | |
|---|---|---|---|
| 3,260,058 | 7/1966 | Ray et al. | 62/23 |
| 4,566,886 | 1/1986 | Fabian et al. | 62/11 |
| 4,638,638 | 1/1987 | Marshall et al. | 62/9 |
| 4,740,223 | 4/1988 | Gates | 62/23 |
| 4,758,253 | 7/1988 | Mitchell et al. | 62/25 |

OTHER PUBLICATIONS

"A Step Ahead for Helium" Kellogram #3, 1963.

*Primary Examiner*—Ronald C. Capossela

*Attorney, Agent, or Firm*—Willard Jones, II; James C. Simmons; William F. Marsh

[57] ABSTRACT

A crude helium product is produced from a natural gas stream containing helium by rectification of the feed gas in a dephlegmator heat exchanger. The process is fully auto-refrigerated, and is capable of achieving a helium recovery of 99% without the use of a recycle compressor or a heat pump compressor. A nitrogen product stream can be produced by addition of a second rectification circuit in the dephlegmator heat exchanger.

21 Claims, 3 Drawing Sheets

DEPHLEGMATOR PROCESS FOR THE RECOVERY OF HELIUM

TECHNICAL FIELD

The present invention is related to a cryogenic process for production of a crude helium stream (i.e; >30 vol % helium) from a pressurized, helium-containing feed gas mixture and more specifically to a dephlegmator process for the production of a crude helium stream.

BACKGROUND OF THE INVENTION

Helium occurs in very low concentrations in certain natural gas fields. Natural gas streams from which helium can be economically recovered typically contain approximately 0.1% to 0.5% helium. This helium must be upgraded to produce a crude helium stream containing typically at least 30% helium.

Producing a crude helium product stream is usually done in two or more successive upgrading steps. The first upgrading step generally produces a crude helium stream containing about 1 to 10% helium, and successive upgrading steps are required to boost the helium content of this stream to 30% or greater.

Due to the high value of the helium, high recovery is usually required. Achieving the high recovery as the helium content is increased from 1 to 10% up to 30% or greater has in the past required the addition of compression machinery. A process which could achieve high helium recovery without the need for additional compression machinery would therefore represent an improvement over the current practice.

In addition to producing crude helium, a helium upgrading process is typically required to also produce a high purity nitrogen stream to be used for cold box purge. The ability of the process to produce this additional product stream with a minimum of added equipment would be a further advantage.

The current practice for producing a crude helium product stream (i.e; >30% helium) includes the multistage flash process and the distillation process. Each of these processes requires additional compression to achieve high helium recovery.

In the flash cycle, which is disclosed in U.S. Pat. No. 3,260,058, feed gas is partially liquefied and phase separated. The vapor thus produced contains about 90% or more of the helium contained in the feed stream. Helium which remains dissolved in the liquid is recovered by subsequent flash steps in which helium-rich vapors are flashed off. These vapors are combined, rewarmed, compressed back to feed pressure and mixed with the feed gas so the helium can be recovered.

In the distillation process, which is disclosed in "A New Approach to Helium Recovery", Kellogram Issue No. 3, M. H. Kellogg Co., 1963, feed gas is partially condensed and fed to a distillation column which produces a helium-rich vapor product stream containing at least 99% of the helium in the feed gas. A heat pump compressor is used to supply reboil to the bottom of the column by condensing high pressure heat pump fluid and reflux to the top of the column by boiling low pressure heat pump fluid.

In each of these cases, additional compression is required to achieve high helium recovery.

SUMMARY OF THE INVENTION

The present invention is an improvement to a process for separating a crude helium product having a helium concentration greater than thirty percent by volume from a pressurized, helium-containing feed gas mixture, such as a feed gas mixture containing helium, natural gas and nitrogen. In the process, the pressurized, helium-containing feed gas mixture is separated (typically, by flashing or stripping or a combination of both) to produce a helium-enriched stream and a helium-lean stream. The helium-enriched stream is further upgraded to produce the crude helium product and at least one residue gas product stream. The improvement for more effectively upgrading the helium-enriched stream to produce the crude helium product comprises the steps of: (a) rectifying the helium-enriched stream in a dephlegmator heat exchanger thereby producing a helium-rich overhead stream and a dephlegmator helium-lean liquid stream; (b) removing the helium-rich overhead stream from the dephlegmator heat exchanger as the crude helium product and warming the crude helium product to recover refrigeration for the dephlegmator heat exchanger; (c) expanding and warming the dephlegmator helium-lean liquid stream to recover refrigeration for the dephlegmator heat exchanger thereby producing a residue stream; and (d) further warming the residue stream and the crude helium product to recover refrigeration for the liquefaction of the pressurized, helium-containing feed gas mixture. Additionally, the process further comprises cooling the dephlegmator helium-lean liquid stream prior to expanding it in step (c). As a preferred embodiment, step (c) can be accomplished by dividing the dephlegmator helium-lean liquid into two portions; expanding the first portion to produce a lower pressure residue stream and warming the lower pressure residue stream to recover refrigeration for the dephlegmator heat exchanger; expanding the second portion to produce a higher pressure residue stream and warming the higher pressure residue stream to recover refrigeration for the dephlegmator heat exchanger. As an additional option, process can further comprise cooling and partially condensing the helium-enriched stream and phase separating out the produced liquids prior to rectification in step (a) and combining the produced liquids with the dephlegmator helium-lean liquid stream prior to expanding the dephlegmator liquid the division in step (c).

As an alternative to this improvement, the present invention also is an embodiment which will produce a nitrogen purge stream from the upgrading section. In this case the improvement comprises the steps of: (a) rectifying the helium-rich vapor stream in a dephlegmator heat exchanger thereby producing a helium-rich overhead stream and a dephlegmator helium-lean liquid stream; (b) removing the helium-rich overhead stream from the dephlegmator heat exchanger as the crude helium product and warming the crude helium product to recover refrigeration for the dephlegmator heat exchanger; (c) flashing the dephlegmator helium-lean liquid stream thereby producing a partially vaporized helium-lean stream; (d) phase separating the partially vaporized helium-lean stream thereby producing a nitrogen-rich vapor stream and a first nitrogen-lean liquid; (e) rectifying the nitrogen-rich vapor stream in a dephlegmator heat exchanger thereby producing a nitrogen-rich overhead stream and a second nitrogen-lean liquid; (f) removing the helium-rich overhead stream from the dephlegmator heat exchanger and warming it to recover refrigeration for the dephlegmator heat exchanger; (g) combining the first and second nitrogen-lean liquids and cooling the combined nitrogen-lean liquids stream; (h) expanding and warming the combined nitrogen-lean liquids stream to recover refrigeration for the dephlegmator heat exchanger thereby producing a residue stream; and (i) warming the residue stream and the helium-rich stream to recover refrigeration for the liquefaction of the pressurized, helium-containing feed gas mixture. Preferably, step (h) can be accomplished by separating the combined nitrogen-lean liquids stream into two portions; expanding the first portion to produce a lower pressure residue stream and warming the lower pressure residue stream to recover refrigeration for the dephlegmator heat exchanger; and expanding the second portion to produce a higher pressure residue stream and warming the higher pressure residue stream to recover refrigeration for the dephlegmator heat exchanger. As an additional option, the process can further comprise cooling and partially condensing the helium-enriched stream and phase separating out the produced liquids prior to rectification in step (a) and combining the produced liquids to the dephlegmator liquid stream prior to flashing of the dephlegmator liquid in step (c).

The improvement of the present invention is particularly suited for a pre-separation or prefractionation section for producing the helium-enriched stream which comprises the following steps: (a) liquefying and subcooling the pressurized, helium-containing feed gas mixture; (b) expanding the liquefied, subcooled, pressurized, helium-containing feed gas mixture whereby said liquefied mixture is partially vaporized and thereby producing a partially vaporized fractionation feed stream; (c) stripping the partially vaporized fractionation feed stream in a cryogenic distillation column thereby producing as an overhead, the helium-enriched stream, and a bottoms liquid, the helium-lean stream; (d) reboiling the cryogenic distillation column by vaporizing the remaining portion of the helium-lean stream. The preferred method of expanding the helium-containing feed gas mixture is with a hydraulic turbine.

DETAILED DESCRIPTION OF THE INVENTION

Figure 1:
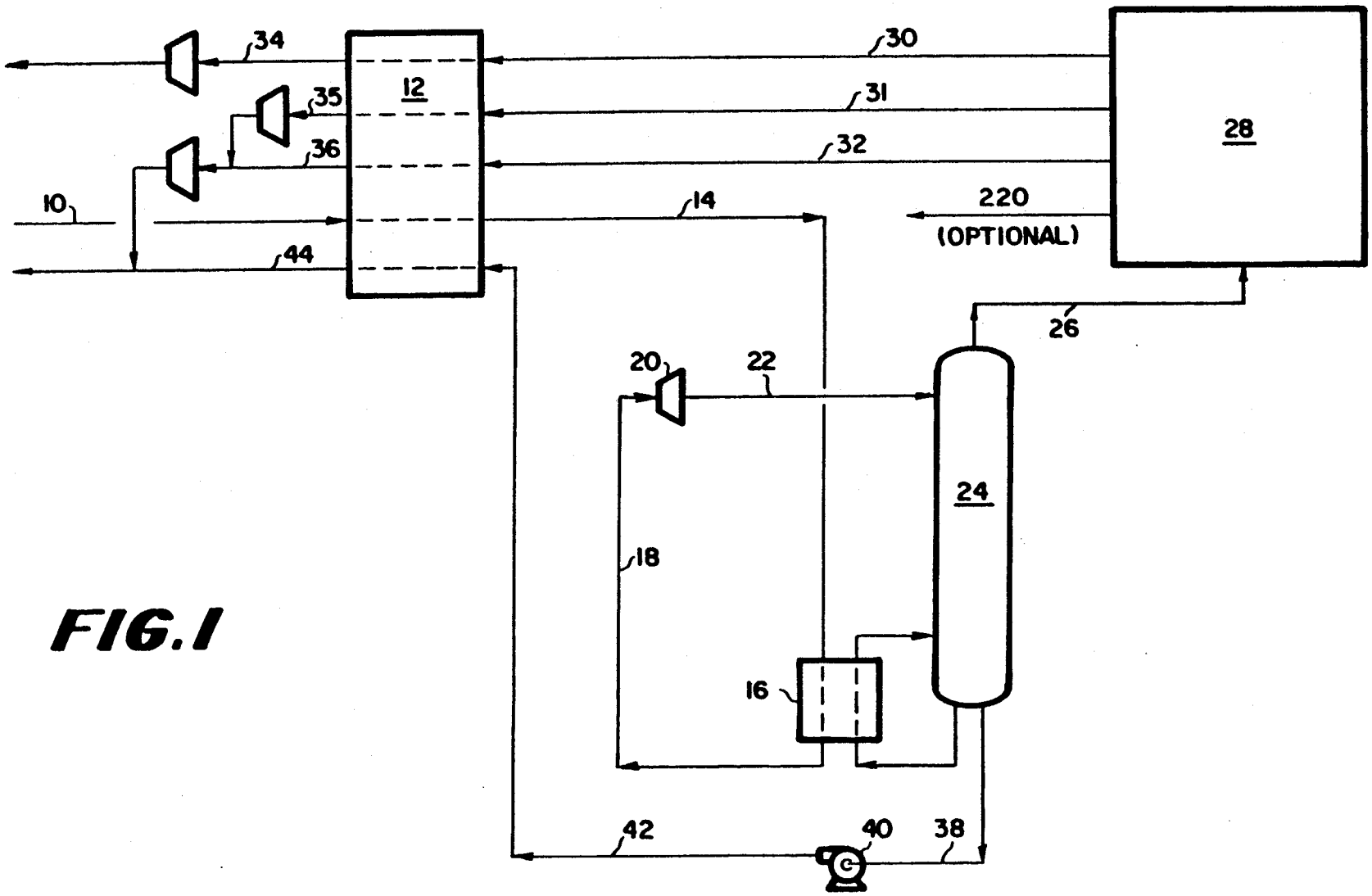
FIG. 1 is an overall schematic of a process for the production of crude helium from a pressurized, helium containing feed gas stream.

As mentioned earlier the present invention is in essence a process for the production of a helium-rich or crude helium stream (containing >30 vol % helium) stream from a natural gas feed gas containing small concentrations of helium and more specifically from a prefractionated helium-enriched stream. The process of the present invention is best understood in relation of the drawing.

FIG. 1 shows the preferred embodiment for the pre-separation or prefractionation section of a typical overall helium recovery unit. FIG. 1 is merely an example of a pre-separation or prefractionation section, other examples can be found in U.S. Pat. No. 3,260,058 and Kellogram Issue #3; the texts of which are hereby incorporated by reference.

Turning to FIG. 1, a natural gas feed stream at a pressure of about 300 to 600 psia and containing about 0.1% to 0.5% helium is introduced through line 10 into main heat exchanger 12, wherein it is liquefied and subcooled, exiting the exchanger at a temperature of about −170° to −200° F. The feed stream is then fed through line 14 into distillation column reboiler 16, in which it is further cooled to a temperature of about −175° to −205° F. The subcooled liquid stream is introduced through line 18 into expander 20, wherein the pressure of the feed stream is reduced to about 150 to 400 psia.

The stream exiting expander 20 is a two-phase stream in which the vapor contains about 85% of the helium contained in the feed gas. This stream is fed through line 22 into distillation column 24 in which the small amount of remaining dissolved helium is stripped from the liquid by stripping vapor generated in reboiler 16.

Figure 2:
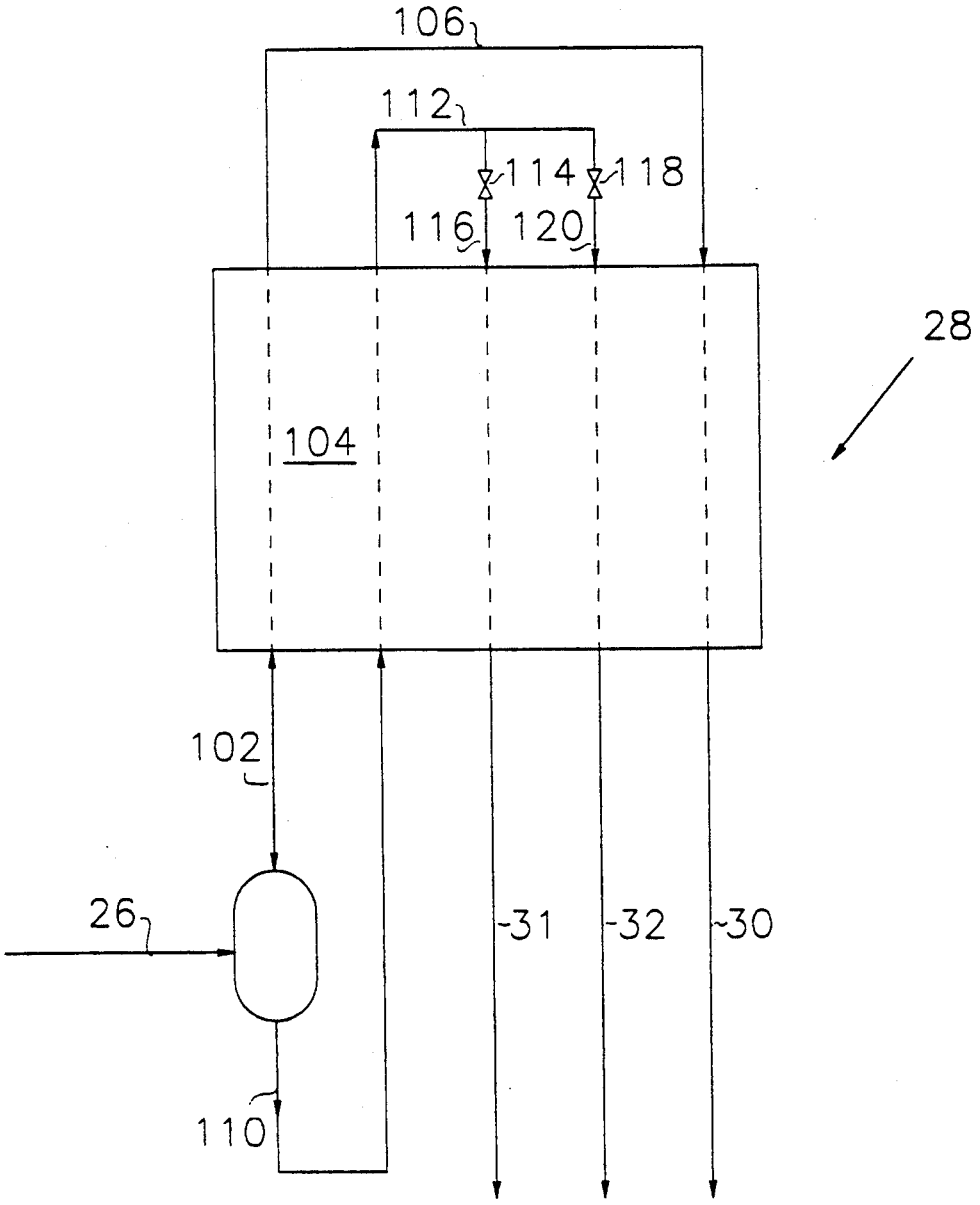
FIG. 2 is an embodiment of the dephlegmator helium recovery process of the present invention.
Figure 3:
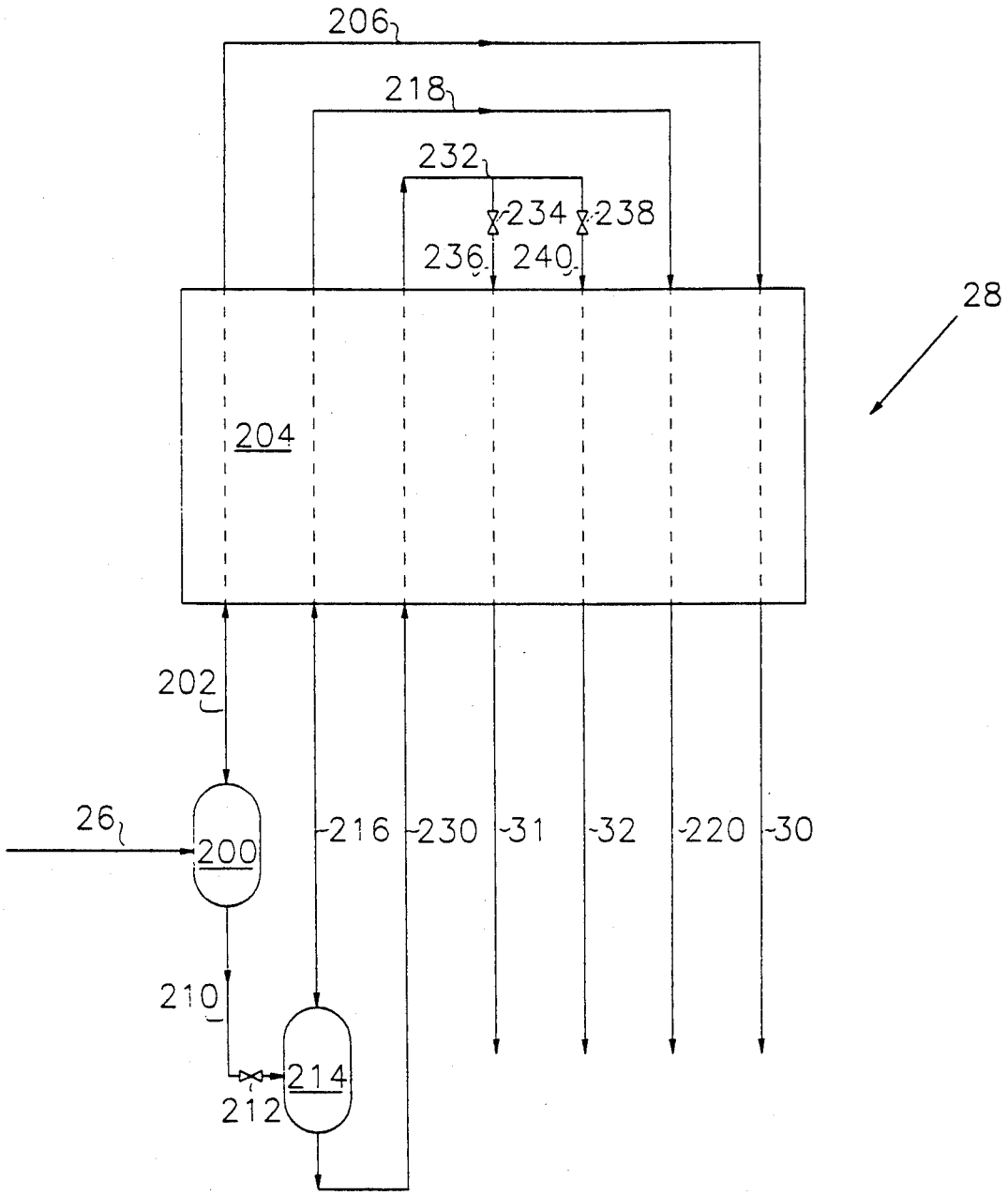
FIG. 3 is an alternate embodiment of the dephlegmator helium recovery process of the present invention.

The vapor recovered off distillation column 24 has a helium content of about 4% to 5%, and its flowrate is only about 10% or less of the feed flowrate. This helium-enriched stream, containing about 99% of the helium contained in the feed gas, is fed through line 26 into a subsequent helium upgrading section 28. The helium upgrading section is illustrated in two alternate embodiments as shown in FIGS. 2 and 3.

Either of these two helium upgrading sections produce three product streams, a crude helium product containing at least 50% helium, a lower pressure residue gas product and a higher pressure residue gas product. These products are returned through lines 30, 31 and 32 to main exchanger 12, wherein they are rewarmed to provide feed refrigeration prior to exiting the process in lines 34, 35 and 36. The helium upgrading section illustrated in FIG. 3, also produces a nitrogen purge stream in line 220.

The liquid product from distillation column 24 has a flowrate which is at least 90% of the feed flowrate. It passes through line 38 to pump 40, in which it is pumped to a pressure of about 240 to 500 psia and fed back to main exchanger 12 through line 42. This liquid stream fully vaporizes in the main exchanger, providing refrigeration for feed liquefaction, and exits the process as primary residue gas product in line 44.

It should be noted that the pressure letdown step, expander 20, is important to the effective running of distillation column 24 at reduced pressure. The preferred mode of expanding the subcooled liquid feed stream, i.e. the most energy efficient mode, is with the use of a hydraulic turbine. The turbine mode generates power which reduces the net energy consumption of the process. In addition, it supplies refrigeration which substantially reduces the size of the main exchanger compared to a flash process returning the high pressure residue gas at the same pressure. Alternatively, using the same size main exchanger for the turbine process as for the flash process allows the residue gas to be returned at higher pressure, thus further reducing energy consumption. Nevertheless, the pressure letdown step can be accomplished with a Joule-Thompson expansion valve, and the process would still produce an upgraded helium stream with higher helium content and lower flowrate than processes known in the prior art.

As mentioned, FIGS. 2 and 3 illustrate two alternative embodiments of the present invention. In FIG. 2, a helium-enriched stream (such as line 26 from FIG. 1) at a pressure of about 150 to 400 psia and containing about 1 to 10% helium is introduced through line 26 into separator 100. Optionally, the helium-enriched stream in line 26 can be cooled and partially liquefied prior to entering the phase separator. The vapor off separator 100 is fed through line 102 to dephlegmator heat exchanger (refluxing heat exchanger) 104, in which the gas flows upward and is cooled to a temperature of about −260° to −290° F. and partially condensed. The condensed liquid runs down the walls of the exchanger passages, refluxing the upflowing vapor, and drains through line 102 back into separator 100.

The helium-rich vapor exiting exchanger 104 contains about 99% of the helium in the feed gas in a concentration of about 50%. It is returned to exchanger 104 through line 106 and rewarmed to provide refrigeration to cool the feed gas. As a further option, this rewarmed stream can be expanded with the production of mechanical work and further warmed to recover the generated refrigeration. The rewarmed stream then exits to the process in FIG. 1 as the crude helium product stream in line 30.

The helium-lean liquid which drains back into separator 100 contains only about 1% of the helium contained in the feed gas. It is withdrawn through line 110 and returned to exchanger 104, wherein it is subcooled, exiting the exchanger through line 112 at a temperature approximately equal to that of the helium product stream in line 106. This subcooled liquid stream is then split into two streams.

The smaller of the streams, comprising about 25% of the total liquid, is flashed through J-T expansion valve 114 to a pressure of about 35 to 100 psia and then fed through line 116 into exchanger 104, wherein it provides low level refrigeration for cooling. The rewarmed stream then exits through line 31 as the lower pressure residue gas stream.

The remaining portion of the liquid is flashed through J-T expansion valve 118 to a pressure of about 120 to 320 psia and then fed through line 120 into exchanger 104, wherein it provides medium level refrigeration for feed cooling. The rewarmed stream exits through line 32 as the higher pressure residue gas stream.

A further embodiment of the process is shown in FIG. 3. The key difference between this embodiment and that shown in FIG. 2 is that the later process produces an additional product—a nitrogen stream which is suitable for cold box purge. This nitrogen stream is produced with a minimum of added equipment by incorporating a second rectification circuit in exchanger 204.

With reference to FIG. 3, a helium-enriched stream (such as stream 26 of FIG. 1) at a pressure of about 150 to 400 psia and containing about 1 to 10% helium is introduced through line 26 into separator 200. The vapor off separator 200 is fed through line 202 to dephlegmator heat exchanger 204, in which the gas is cooled to a temperature of about −260° to −290° F. and partially condensed. The condensed liquid runs down the walls of the exchanger passages, refluxing the upflowing vapor, and drains through line 202 back into separator 200.

The helium-rich vapor exiting exchanger 204 contains about 99% of the helium in the feed gas in a concentration of at least 50%. It is returned to exchanger 204 through line 206 and rewarmed to provide refrigeration to cool the feed gas. The rewarmed stream then exits as the crude helium product stream in line 30.

The helium-lean liquid which drains back into separator 200 contains only about 1% of the helium contained in the feed gas. It is withdrawn through line 210 and flashed through J-T expansion valve 212 to a pressure of about 125 to 325 psia, such that a small amount of nitrogen-rich vapor is evolved. The two-phase mixture is then introduced into separator 214.

The vapor withdrawn from separator 214 has a nitrogen content of about 75%. It is fed through line 216 to dephlegmator heat exchanger 204, in which the gas is cooled to a temperature of about −260° to −290° F. and partially condensed. The condensed liquid runs down the walls of the exchanger passages, refluxing the upflowing vapor, and drains through line 216 back into separator 214.

The vapor exiting exchanger 204 contains less than 1% methane, with the balance consisting of nitrogen and helium. It is returned to exchanger 204 through line 218 and rewarmed to provide refrigeration to cool the feed gas. The rewarmed stream then exits the process as the nitrogen product stream in line 220.

The liquid condensed in exchanger 204 drains through line 216 back into separator 214, combining with the liquid in the separator. This combined liquid stream is withdrawn through line 230 and returned to exchanger 204, wherein it is subcooled, exiting the exchanger through line 232 at a temperature approximately equal to that of the helium product stream in line 206. This subcooled liquid stream is then split into two streams.

The smaller of the streams, comprising about 25% of the total liquid, is flashed through J-T expansion valve 234 to a pressure of about 35 to 100 psia and then feed through line 236 into exchanger 204, wherein it provides low level refrigeration for feed cooling. The rewarmed stream then exits through line 31 as the lower pressure residue gas stream.

The remaining portion of the liquid is flashed through J-T expansion valve 238 to a pressure of about 120 to 320 psia and then fed through line 240 into exchanger 204, wherein it provides medium level refrigeration for feed cooling. The rewarmed stream exits through line 32 as the higher pressure residue gas stream.

The process of the present invention has many benefits over the prior art, among these are the following:

The present invention limits the amount of helium contained in the helium-lean liquid product stream by performing a rectification of the feed stream in a dephlegmator heat exchanger. In this rectification process, the liquid product stream is in contact with a feed stream which has a relatively low concentration of helium. Therefore, the equilibrium concentration of helium in the liquid phase is relatively low, and this liquid does not have to be further processed to achieve high helium recovery.

The use of a dephlegmator heat exchanger allows a high efficiency to be achieved for the rectification process. The refrigeration required to condense the liquid is supplied over a wide temperature range by warming the gas product streams in the dephlegmator heat exchanger. A typical rectification process utilizing an overhead condenser would require that all the refrigeration be supplied at the lowest process temperature, and would have extremely high energy requirements.

A nitrogen stream for cold box purge is produced by incorporating an additional dephlegmation service in the dephlegmator exchanger. Thus the only added equipment required is a phase separator.

Recalling the prior art, past attempts to produce a crude helium product have performed the bulk of the separation in a single partial condensation step. The helium-lean liquid thus produced is in equilibrium with a vapor which has a relatively high helium content. The equilibrium amount of helium in the liquid phase is therefore unacceptably high, and further processing of the liquid is necessary. Also, in the multi-stage flash process, the further processing involves successive flashes of the liquid to evolve helium-rich vapors which are recompressed and combined with the feed gas mixture. In the distillation process, the further processing involves stripping of the liquid by condensing heat pump fluid in the stripper reboiler. In either case, an additional compression service is required, which is not required in the present invention.

The present invention has been described with reference to several embodiments for the separation of helium from helium-containing feed gas mixtures. The present invention is also applicable to the separation of other light gases from gas mixtures containing at least a light gas and a heavy gas wherein the relative volativity of the light and heavy gases is greater than 2.0. Examples of such separations are hydrogen from a hydrogen/carbon monoxide gas mixture or hydrogen from a hydrogen/methane mixture.

The present invention has been described with reference to specific embodiments thereof. These embodiments should not be viewed as limitations on the present invention, the only such limitations being ascertained by the following claims.

What is claimed is:

1. In a process for separating a crude helium product having a helium concentration greater than thirty percent by volume from a pressurized, helium-containing feed gas mixture, wherein the pressurized, helium-containing feed gas mixture is separated to produce a helium-enriched stream and a helium-lean stream, and wherein the helium-enriched stream is further upgraded to produce the crude helium product and at least one residue gas product stream, the improvement for more effectively upgrading the helium-enriched stream to produce the crude helium product comprises the steps of:

(a) rectifying the helium-enriched stream in a dephlegmator heat exchanger thereby producing a helium-rich overhead stream and a dephlegmator helium-lean liquid stream;

(b) removing the helium-rich overhead stream from the dephlegmator heat exchanger as the crude helium product and warming the crude helium product to recover refrigeration for the dephlegmator heat exchanger;

(c) expanding and warming the helium-lean liquid stream to recover refrigeration for the dephlegmator heat exchanger thereby producing a residue stream; and (d) further warming the residue stream and the crude helium product to recover refrigeration for the liquefaction of the pressurized, helium-containing feed gas mixture.

2. The process of claim 1 which further comprises cooling and partially condensing the helium-enriched stream and phase separating out the produced liquids prior to rectification in step (a) and combining the produced liquids with the dephlegmator helium-lean liquid stream prior to expanding the dephlegmator liquid stream in step (c).

3. The process of claim 1 wherein in expanding and warming the dephlegmator helium-lean liquid stream to recover refrigeration of step (c) comprises dividing the helium-lean liquid stream into two portions; expanding the first portion to produce a lower pressure residue stream and warming the lower pressure residue stream to recover refrigeration for the dephlegmator heat exchanger.

4. The process of claim 1 wherein the helium-containing feed gas mixture comprises helium, natural gas and nitrogen.

5. In a process for separating a crude helium product having a helium concentration greater than thirty percent by volume from a pressurized, helium-containing feed gas mixture, wherein the pressurized, helium-containing feed gas mixture is separated to produce a helium-enriched stream and a helium-lean stream, and wherein the helium-enriched stream is further upgraded to produce the crude helium product and at least one residue gas product stream, the improvement for more effectively upgrading the, helium-enriched stream to produce the crude helium product comprises the steps of:

(a) rectifying the helium-rich vapor stream in a dephlegmator heat exchanger thereby producing a helium-rich overhead stream and a dephlegmator helium-lean liquid stream;

(b) removing the helium-rich overhead stream from the dephlegmator heat exchanger as the crude helium product and warming the crude helium product to recover refrigeration for the dephlegmator heat exchanger;

(c) flashing the dephlegmator helium-lean liquid stream thereby producing a partially vaporized helium-lean stream;

(d) phase separating the partially vaporized helium-lean stream thereby producing a nitrogen-rich vapor stream and a first nitrogen-lean liquid;

(e) rectifying the nitrogen-rich vapor stream in the dephlegmator heat exchanger thereby producing a nitrogen-rich overhead stream and a second nitrogen-lean liquid;

(f) removing the helium-rich overhead stream from the dephlegmator and warming it to recover refrigeration for the dephlegmator heat exchanger;

(g) combining the first and second nitrogen-lean liquids and cooling the combined nitrogen-lean liquids stream;

(h) expanding and warming the combined nitrogen-lean liquids stream to recover refrigeration for the dephlegmator heat exchanger thereby producing a residue stream; and (i) further warming the residue stream and the crude helium product to recover refrigeration for the liquefaction of the pressurized, helium-containing feed gas mixture.

6. The process of claim 5 which further comprises cooling and partially condensing the helium-enriched stream and phase separating out the produced liquids prior to rectification in step (a) and combining the produced liquids to the dephlegmator liquid stream prior to flashing of the dephlegmator liquid in step (c).

7. The process of claim 5 wherein in expanding and warming the combined nitrogen-lean liquids stream to recover refrigeration of step (h) comprises dividing the nitrogen-lean liquids stream into two portions; expanding the first portion to produce a lower pressure residue stream and warming the lower pressure residue stream to recover refrigeration for the dephlegmator; expanding the second portion to produce a higher pressure residue stream and warming the higher pressure residue stream to recover refrigeration for the dephlegmator.

8. The process of claim 5 wherein the helium-containing feed gas mixture comprises helium, natural gas and nitrogen.

9. A process for separating a crude helium product stream having a helium concentration greater than thirty percent by volume from a pressurized, helium-containing feed gas mixture comprising the steps of:

(a) liquefying and subcooling the pressurized, helium-containing feed gas mixture;

(b) expanding the liquefied, subcooled, pressurized, helium-containing feed gas mixture whereby said liquefied mixture is partially vaporized and thereby producing a partially vaporized fractionation feed stream;

(c) stripping the partially vaporized fractionation feed stream in a cryogenic distillation column thereby producing as an overhead, the helium-enriched stream, and a bottoms liquid, the helium-lea stream;

(d) reboiling the cryogenic distillation column by vaporizing at least a portion of the helium-lean stream;

(e) rectifying the helium-enriched stream in a dephlegmator heat exchanger thereby producing a helium-rich overhead stream and a dephlegmator helium-lean liquid stream;

(f) removing the helium-rich overhead stream from the dephlegmator heat exchanger as the crude helium product and warming the crude helium product to recover refrigeration for the dephlegmator heat exchanger;

(g) expanding and warming the helium-lean liquid stream to recover refrigeration for the dephlegmator heat exchanger thereby producing a residue stream; and (d) further warming the residue stream and the crude helium product to recover refrigeration for the liquefaction of the pressurized, helium-containing feed gas mixture.

10. The process of claim 9 wherein in expanding and warming the dephlegmator helium-lean liquid stream to recover refrigeration of step (g) comprises dividing the helium-lean liquid stream into two portions; expanding the first portion to produce a lower pressure residue stream and warming the lower pressure residue stream to recover refrigeration for the dephlegmator heat exchanger; expanding the second portion to produce a higher pressure residue stream and warming the higher pressure residue stream to recover refrigeration for the dephlegmator heat exchanger.

11. The process of claim 9 wherein the liquefied, subcooled pressurized, helium-containing feed gas mixture is expanded so as to produce mechanical work.

12. The process of claim 9 wherein the liquefied, subcooled pressurized, helium-containing feed gas mixture is expanded across a hydraulic turbine.

13. The process of claim 9 which further comprises cooling and partially condensing the helium-enriched stream and phase separating out the produced liquids prior to rectification in step (e) and combining the produced liquids to the dephlegmator liquid stream prior to dividing the dephlegmator liquid stream in step (g).

14. The process of claim 9 wherein the helium-containing feed gas mixture comprises helium, natural gas and nitrogen.

15. A process for separating a crude helium product stream having a helium concentration greater than thirty percent by volume from a pressurized, helium and nitrogen containing feed gas mixture comprising the steps of:

(a) liquefying and subcooling the pressurized, feed gas mixture;

(b) expanding the liquefied, subcooled, pressurized, feed gas mixture whereby said liquefied mixture is partially vaporized and thereby producing a partially vaporized fractionation feed stream;

(c) stripping the partially vaporized fractionation feed stream in a cryogenic distillation column thereby producing as an overhead, the helium-enriched stream, and a bottoms liquid, the helium-lean stream;

(d) reboiling the cryogenic distillation column by vaporizing at least a portion of the helium-lean stream;

(e) rectifying the helium-rich vapor stream in the dephlegmator heat exchanger thereby producing a helium-rich overhead stream and a dephlegmator helium-lean liquid stream;

(f) removing the helium-rich overhead stream from the dephlegmator heat exchanger as the crude helium product and warming the crude helium product to recover refrigeration for the dephlegmator heat exchanger;

(g) flashing the dephlegmator helium-lean liquid stream thereby producing a partially vaporized helium-lean stream;

(h) phase separating the partially vaporized helium-lean stream thereby producing a nitrogen-rich vapor stream and a first nitrogen-lean liquid;

(i) rectifying the nitrogen-rich vapor stream in a dephlegmator heat exchanger thereby producing a nitrogen-rich overhead stream and a second nitrogen-lean liquid;

(j) removing the helium-rich overhead stream from the dephlegmator heat exchanger and warming it to recover refrigeration for the dephlegmator heat exchanger;

(k) combining the first and second nitrogen-lean liquids and cooling the combined nitrogen-lean liquids stream;

(1) expanding and warming the combined nitrogen-lean liquids stream to recover refrigeration for the dephlegmator heat exchanger thereby producing a residue stream; and (m) further warming the residue stream and the crude helium product to recover refrigeration for the liquefaction of the pressurized, helium-containing feed gas mixture.

16. The process of claim 15 wherein in expanding and warming the combined nitrogen-lean liquids stream to recover refrigeration of step (l) comprises dividing the nitrogen-lean liquids stream into two portions; expanding the first portion to produce a lower pressure residue stream and warming the lower pressure residue stream to recover refrigeration for the dephlegmator heat exchanger; expanding the second portion to produce a higher pressure residue stream and warming the higher pressure residue stream to recover refrigeration for the dephlegmator heat exchanger.

17. The process of claim 15 wherein the liquefied, subcooled pressurized, helium-containing feed gas mixture is expanded so as to produce methanical work.

18. The process of claim 15 wherein the liquefied, subcooled pressurized, helium-containing feed gas mixture is expanded across a hydraulic turbine.

19. The process of claim 15 which further comprises cooling and partially condensing the helium-enriched stream and phase separating out the produced liquids prior to rectification in step (e) and combining the produced liquids to the dephlegmator liquid stream prior to flashing the dephlegmator stream in step (g).

20. The process of claim 15 wherein the helium-containing feed gas mixture comprises helium, natural gas and nitrogen.

21. A dephlegmator heat exchanger process for the separation of a light gas from a gas mixture comprising at least the light gas and a heavier gas comprising the following steps:

(a) rectifying the gas mixture in a dephlegmator heat exchanger thereby producing a light gas-rich overhead stream and a light gas-lean liquid stream;

(b) removing the light gas-rich overhead stream from the dephlegmator heat exchanger as the crude light gas product and warming the crude light gas product to recover refrigeration for the dephlegmator heat exchanger; and (c) expanding and warming the light gas-lean liquid stream to recover refrigeration for the dephlegmator heat exchanger.

* * * * *